US005202618A

United States Patent [19]

Nishimura

[11] Patent Number: 5,202,618

[45] Date of Patent: Apr. 13, 1993

[54] POWER SUPPLY SYSTEM FOR ELECTRIC CIRCUITS DIFFERENT IN OPERATING VOLTAGE

[75] Inventor: Kouichi Nishimura, Tokyo, Japan

[73] Assignee: NEC Corporation, Japan

[21] Appl. No.: 825,998

[22] Filed: Jan. 27, 1992

[30] Foreign Application Priority Data

Feb. 6, 1991 [JP] Japan ..... 3-14630

[51] Int. Cl.[5] ..... G05F 1/44

[52] U.S. Cl. ..... 323/270; 323/273; 307/33; 307/36

[58] Field of Search ..... 307/296.1, 296.3, 31, 307/33, 36; 323/273, 313, 314, 268, 270, 311, 312, 350

[56] References Cited

U.S. PATENT DOCUMENTS 4,614,906 9/1986 Maxham ..... 323/267

4,652,769 3/1987 Smith et al. ..... 307/31

*Primary Examiner*—Steven L. Stephan

*Assistant Examiner*—Adolf Berhane

*Attorney, Agent, or Firm*—Laff, Whitesel, Conte & Saret

[57] ABSTRACT

An electric power supply system distributes power voltage levels to electric circuits different in operating voltage from one another, and comprises a plurality of step-down units each coupling two of the electric circuits, wherein each of the plurality of step-down units comprises a first step-down transistor having an emitter-and-collector current path coupled between the associated two electric circuits, and a second step-down transistor having an emitter-and-collector current path between one of the associated two electric circuit and another step-down unit so that part of current from one of the associated two electric circuits is reused in the other of the associated two electric circuits.

6 Claims, 5 Drawing Sheets

POWER SUPPLY SYSTEM FOR ELECTRIC CIRCUITS DIFFERENT IN OPERATING VOLTAGE

FIELD OF THE INVENTION

This invention relates to a power supply system and, more particularly, to a power supply system for electric circuits which required different operating voltage.

DESCRIPTION OF THE RELATED ART

A typical example of the power supply system is illustrated in FIG. 1, and is associated with two electric circuits 1 and 2. The first electric circuit 1 is operable with power voltage levels VH1 and VL1, and power voltage levels VH2 and VL2 are supplied to the second power voltage levels VH2 and VL2. The power voltage levels VH1, VL1, VH2 and VL2 are different from one another, and the prior art power supply system 3 produces those power voltage levels VH1, VL1, VH2 and VL2 through voltage division.

The power supply system 3 has four output nodes N1, N2, N3 and N4. The maximum voltage level Vcc and the minimum voltage level GND are directly supplied to the output nodes N1 and N2. A p-n-p type bipolar transistor Q1 is coupled between the output nodes N3 and N2, and a reference voltage level Vr1 is supplied to the base node of the p-n-p type bipolar transistor Q1. Therefore, the output node N3 is applied with the voltage level (Vr1+0.7) volt, and the first electric circuit 1 is operable with the power voltage level VH1=Vcc and with the power voltage level $VL1=(Vr1+0.7)$ volt. An n-p-n type bipolar transistor Q2 is provided for the output node N4. The collector node of the n-p-n type bipolar transistor Q2 is supplied with the maximum voltage level Vcc, and the emitter node is coupled with the output node N4. The reference voltage level Vr1 is also supplied to the base node of the n-p-n type bipolar transistor Q2, and the voltage level (Vr1−0.7) volt is produced at the output node N4. Then, the second electric circuit 2 is operable with the power voltage level $VH2=(Vr1-0.7)$ volt and with the power voltage level VL2=GND.

The prior art power supply system 3 is desirable in view of withstand voltage of component transistors. Namely, the difference in voltage level between the power voltage levels VH1 and VL1 is (Vcc−Vr1−0.7) volt, and the component transistors of the first electric circuit 1 are expected to withstand the differential voltage level (Vcc−Vr1−0.7) volt. Similarly, the difference in voltage level between the power voltage levels VH2 and VL2 is given as (Vr1−0.7−GND or 0), and the maximum differential voltage applied across the component transistors of the second electric circuit 2 never exceeds (Vr1−0.7) volt.

However, a problem is encountered in the prior art power supply system in power consumption. In detail, assuming now that currents Ic1 and Ic2 respectively flow through the electric circuits 1 and 2, the total power consumption P0 is given as $$P0=Vcc\,(Ic1+Ic2) \qquad \text{Equation 1}$$

However, the bipolar transistors Q2 and Q1 consume electric power P0′ given as $$P0'=(Vr1+0.7)Ic1+(Vcc-Vr1+0.7)Ic2 \qquad \text{Equation 2}$$

The electric power P0′ is consumed for producing the step-down voltage levels (Vr1+0.7) volt and (Vr1−0.7) volt, and, accordingly, is ineffectual for the functions of the electric circuits 1 and 2. If the number of the electric circuits coupled with the prior art power supply system 3 is increased, a large amount of electric power is wasted.

SUMMARY OF THE INVENTION

It is therefore an important object of the present invention provide a power supply system which supplies various power voltage levels to electric circuits without an ineffectual use of power.

To accomplish the object, the present invention proposes to reuse current flowing out from a circuit.

In accordance with the present invention, there is provided an electric power supply system associated with a plurality of circuits including first, second, third and final circuits operating at different voltage level, comprising: a) a first power supply line coupled with a first power node of the first circuit; b) a second power supply line coupled with a second power node of the final circuit; c) a plurality of step-down units including first and second step down units similar in circuit arrangement to one another, and each provided in association with two of the plurality of circuits, the first and second step-down units being associated with the first and second circuits and with the second and third circuits, respectively, the first step-down unit comprising c-1) a first step-down transistor having an emitter-and-collector current path coupled between a second power node of the first circuit and a first power node of the second circuit for supplying first branch current of current flowing out from the first circuit to the first power node of the second circuit, and c-2) a second step-down transistor different in conductivity of a base region from the first step-down transistor, and having an emitter-and-collector current path coupled between the second power node of the first circuit and a second power node of the second circuit for bypassing second branch current of the current from the first circuit to the second step-down unit; and d) a bias circuit producing at least a first reference voltage level supplied to the base nodes of the first and second step-down transistors.

BRIEF DESCRIPTION OF THE DRAWINGS

The feature and advantages of the power supply system according to the present invention will be more clearly understood from the following description taken in conjunction with the accompanying drawings in which.

DESCRIPTION OF THE PREFERRED EMBODIMENTS

First Embodiment

Figure 1:
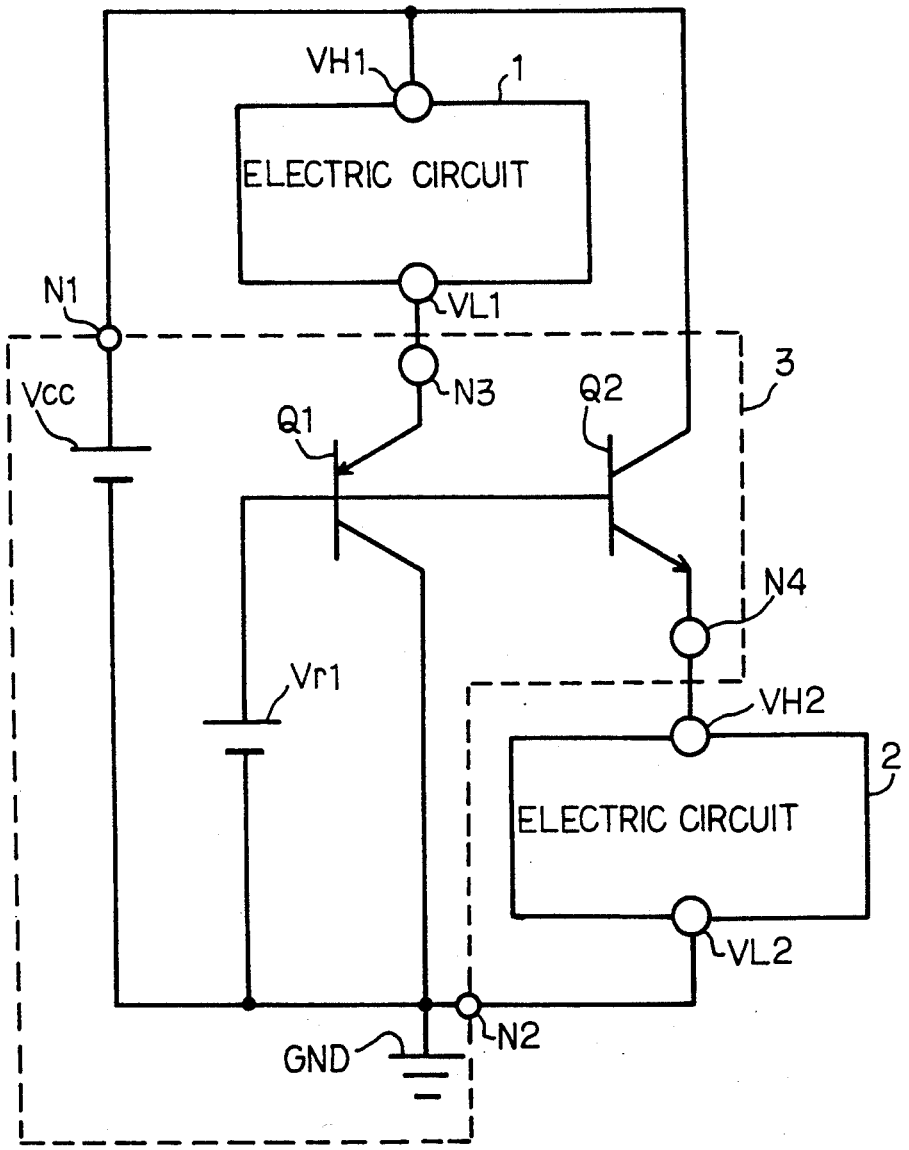
Fig·1 PRIOR ART
FIG. 1 is a circuit diagram showing the arrangement of the prior art power supply system.
Figure 2:
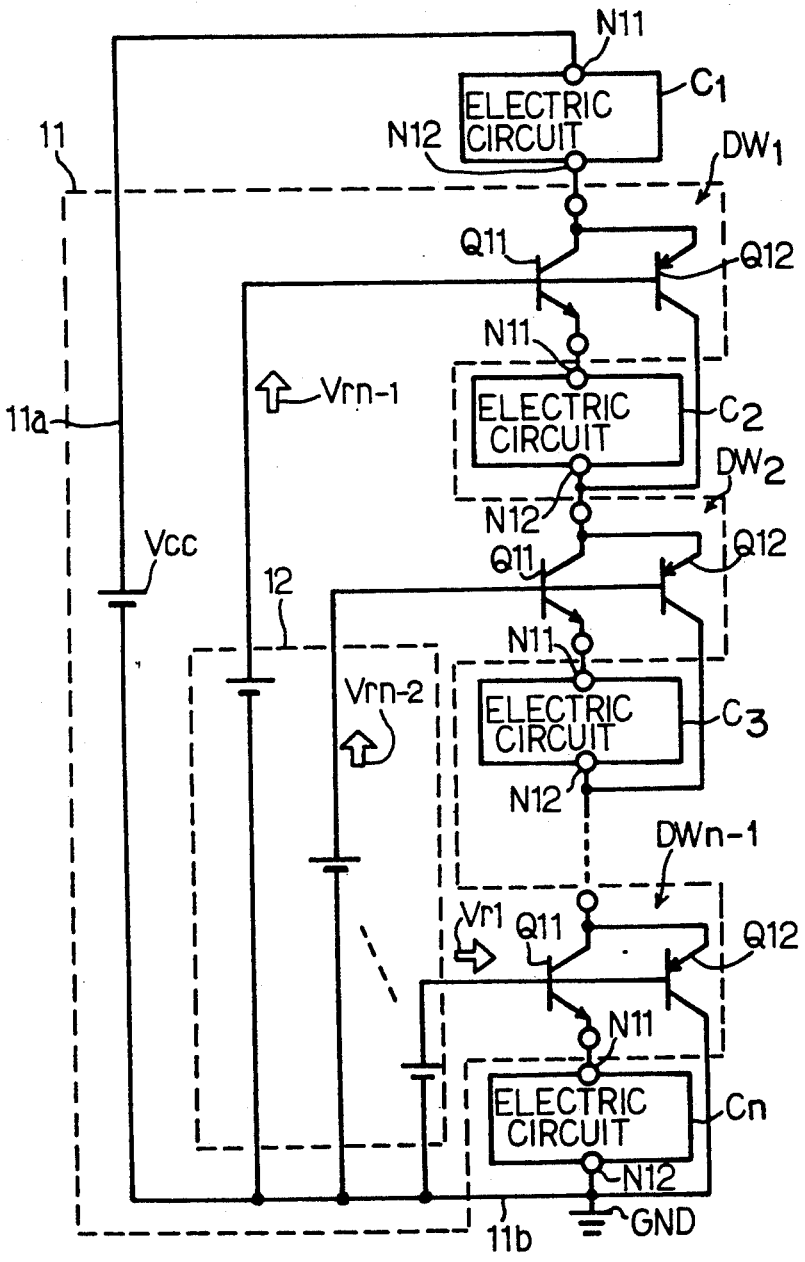
FIG. 2 is a circuit diagram showing the arrangement of a power supply system according to the present invention.

Referring to FIG. 2 of the drawings, an electric power supply system 11 embodying the present invention is provided in association with electric circuits C1, . . . Cn-2, Cn-1 and Cn different in operating voltage level from one another, and each of the electric circuits C1 to Cn has a pair of power nodes N11 and N12 supplied with high and low power voltage levels, respectively. The electric power supply system 11 largely comprises a first power supply line 11*a* for propagating the maximum power voltage level Vcc, a second power supply line 11*b* for propagating the minimum power voltage level GND, a plurality of step-down units DW1, . . . DWn-2 and DWn-1 each associated with two of the electric circuits C1 to Cn, and a bias unit 12 for producing reference voltage levels Vr1, Vrn-2, . . . and Vrn-1. Each of the plurality of step-down units DW1 to DWn-1 is provided in association with two of the electric circuits C1 to Cn. For example, the step down circuit DW1 is associated with the electric circuits C1 and C2 (not shown), the step down circuit DWn-2 is provided for the electric circuits Cn-2 and Cn-1, and the step down circuit DWn-1 is associated with the electric circuits Cn-1 and Cn. Each of the step-down units DW1 to DWn-1 is implemented by a parallel combination of an n-p-n type first step-down transistor Q11 and a p-n-p type second step-down transistor Q12. The n-p-n type first step-down transistor Q11 is coupled between the second power node N12 of one of the associated two electric circuits and the first power node of the other associated electric circuit, and the p-n-p type second step-down transistor Q12 is coupled between the second power node N12 of one of the associated two electric circuits and the second power node of the other associated electric circuit. Each of the reference voltage levels Vr1 to Vrn-1 is supplied to the base nodes of the step-down transistors Q11 and Q12 of the associated step-down unit.

The reference voltage levels Vr1 to Vrn-1 are respectively supplied to the step-down units DW1 to DWn-1, and are regulated as $$Vcc > Vrn\text{-}1 > Vrn\text{-}2 > Vr1$$

Therefore, the electric circuit Cn is operable with the power voltage levels Vcc and (Vrn-1+0.7) volt, the electric circuit Cn-1 has an operating voltage range between (Vrn-1−0.7) volt and (Vrn-2+0.7) volt, and the electric circuit C1 is operable with the power voltage levels (Vr1−0.7) volts and the ground voltage level GND.

Currents Ic1, Icn-2, Icn-1 and Icn respectively flow through the electric circuits C1, Cn-2, Cn-1 and Cn, and the currents Ic1 to Icn are sequentially decreased as expressed by the following inequality.

$$Ic1 > Ic2 > Ic3 > Icn$$

Current flowing out from an electric circuit is distributed to the next electric circuit and the electric circuit after the next electric circuit. In detail, the current Ic1 is split into two currents Ic2 and (Ic1+. . .+Icn), and the current Ic2 is reused in the next electric circuit C2 through the first step-down transistor Q11. The second step-down transistor Q12 bypasses the other current (Ic1+. . .+Icn) to the next step-down unit DW2. In the similar manner, each of the first step-down transistors Q11 allows part of the current from the previous electric circuit to be reused in the next electric circuit, and the second step-down transistor Q12 relays the residual current to the next step-down unit.

As will be understood from the foregoing description, the electric power system according to the present invention allows electric circuits to reuse current flowing out of the previous electric circuits, and the current consumption is improved.

Second Embodiment

Figure 3:
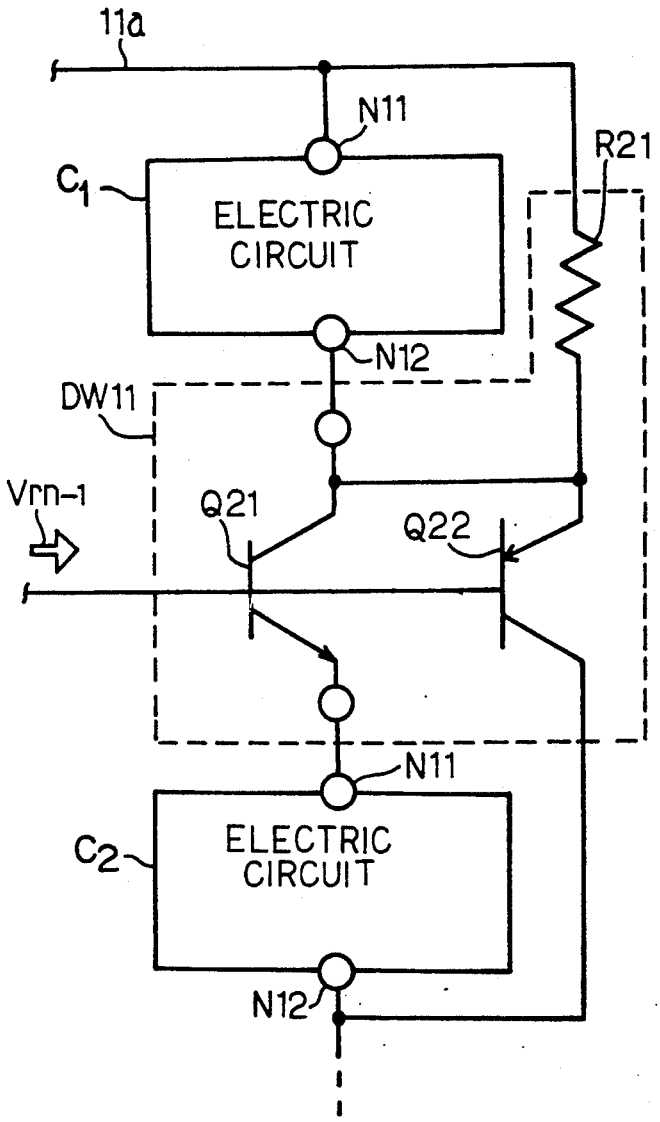
FIG. 3 is a circuit diagram showing the arrangement of a step-down unit incorporated in another electric power supply system according to the present invention.

Turing to FIG. 3 of the drawings, a step-down unit DW11 incorporated in another electric power supply system embodying the present invention comprises an n-p-n type step-down transistor Q21, a p-n-p type step-down transistor Q22 and a resistive element R21, and the other circuit arrangement is similar to the first embodiment. The other components are labeled with the same references used in FIG. 2. The step-down unit DW11 is associated with the electric circuits C1 and C2. However, the electric circuit Cn-1 has a larger current consumption than the electric circuit Cn, has and the resistive element R21 supplements current supplied to the next step-down unit. The current Ir21 passing through the resistive element R21 is calculated as $$Ir21 = (Vcc - Vrn\text{-}1 - 0.7)/r21 \qquad \text{Equation 3}$$

where r21 is the resistance of the resistive element R21. The resistance r21 satisfies the following inequality $$Ir21 > Imax - Ic1$$

where Imax is the maximum current of all the currents Ic2-1, Ic3, . . . and Icn.

The electric power supply system implementing the second embodiment is preferable for a system which has the maximum current-consuming circuit between other electric circuits. The advantages of the first embodiment are also achieved by the second embodiment, and no further description is incorporated hereinbelow for avoiding repetition.

Third Embodiment

Figure 4:
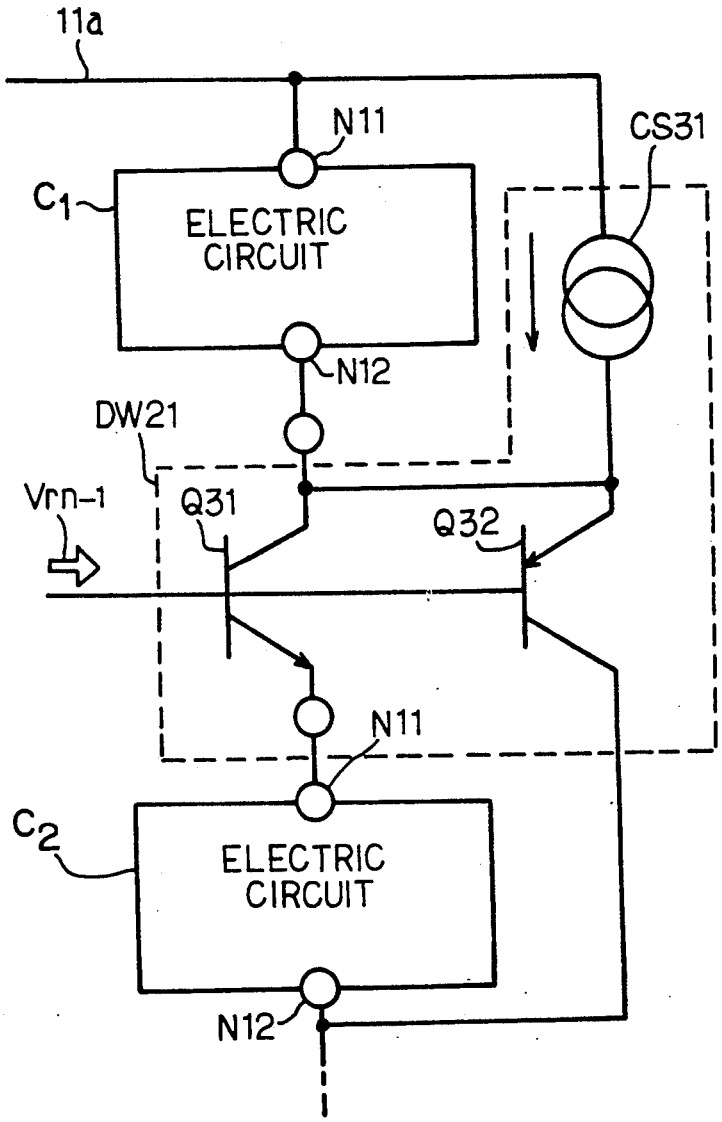
FIG. 4 is a circuit diagram showing the arrangement of a step-down unit incorporated in yet another electric power supply system according to the present invention.

Turning to FIG. 4 of the drawings, another step-down unit DW21 incorporated in yet another electric power supply system embodying the present invention is provided in association with the electric circuits C1 and C2, and comprises an n-p-n type first step-down transistor Q31, a p-n-p type second step-down transistor Q32 and a constant current source CS31. The resistive element R21 of the second embodiment is replaced with the constant current source CS31, and the other circuit arrangement is similar to the second embodiment. The constant current source CS31 supplies current Ics31 to the second step-down transistor Q32, and the current Ics31 is determined as follows.

$$Ics31 > Imax - Ic1$$

where Imax is the maximum current of all the currents Ic2 1, Ic3, . . . and Icn.

The electric power supply system implementing the third embodiment is also preferable for a system which has the maximum current-consuming circuit between other electric circuits, and the advantages of the first embodiment are also achieved by the third embodiment.

Fourth Embodiment

Figure 5:
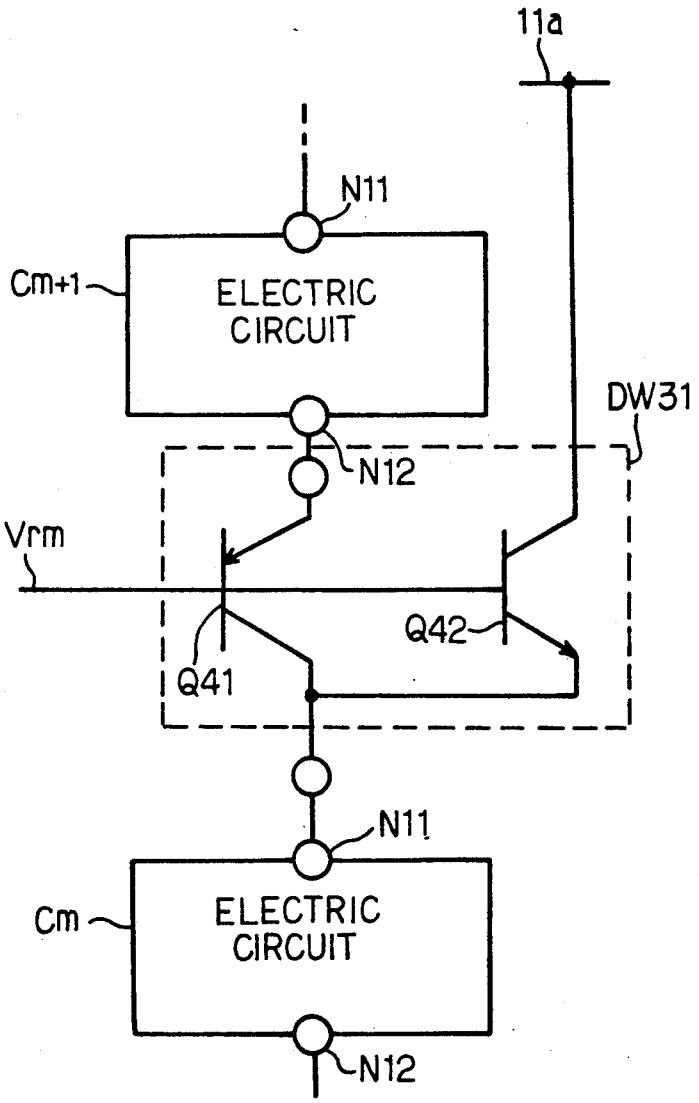
FIG. 5 is a circuit diagram showing the arrangement of a step-down circuit incorporated in yet another electric power supply system according to the present invention.

Turning to FIG. 5 of the drawings, a step-down unit DW31 incorporated in yet another electric power supply system embodying the present invention is provided in association with electric circuits Cm and Cm+1 where m is less than n and not less than 1. The other arrangement is similar to that of the first embodiment, and no further description is incorporated hereinbelow for the sake of simplicity. The step-down unit DW31 comprises a p-n-p type step-down transistor Q41 coupled between the electric circuits Cm+1 and Cm, and an n-p-n type step down transistor Q42 coupled between the first power supply line 11*a* and the electric circuit Cm. A reference voltage level Vrm is supplied from the bias unit 12 to the base nodes of the step-down transistors Q41 and Q42, and the n-p-n type bipolar transistor Q42 supplements current Iq42 to the electric circuit Cm. The current Iq42 is approximately equal to the difference between current Im+1 consumed by the electric circuit Cm+1 and current Im consumed by the electric circuit Cm.

Although particular embodiments of the present invention have been shown and described, it will be obvious to those skilled in the art that various changes and modifications may be made without departing from the spirit and scope of the present invention.

What is claimed is:

1. An electric power supply system associated with a plurality of circuits including first, second, third through nth circuits that operate at voltage levels which are different from one another, said system comprising:

a) a first power supply line coupled to a first power node of said first circuit;

b) a second power supply line coupled to a second power node of said nth circuit;

c) a plurality of step-down units including first and second step down units having similar circuit arrangement with respect to one another, each of said step-down units being associated with two of said plurality of circuits, said first and second step-down units being associated with said first and second circuits and with said second and third circuits, respectively, said first step-down unit comprising c-1) a first step-down transistor of a first conductivity type having an emitter-and-collector current path coupled between a second power node of said first circuit and a first power node of said second circuit for supplying a first branch current taken from current flowing out from said first circuit to said first power node of said second circuit, and c-2) a second step-down transistor having a conductivity type of a base region which is different from that of said first step-down transistor, and having an emitter-and-collector current path coupled between said second power node of said first circuit and a second power node of said second circuit for enabling a second branch current taken from said current from said first circuit to said second step-down unit, said second step-down unit comprising c-3) a third step-down transistor having an emitter-and-collector current path coupled between a second power node of said second circuit and a first power node of said third circuit for supplying a third sub-branch current of said second branch current to said first power node of said third circuit and c-4) a fourth step-down transistor having a conductivity type of a base region which is different from that of said third step-down transistor, and having an emitter-and-collector current path coupled between said second power node of said second circuit and a second power node of said third circuit for enabling a fourth sub-branch current of said second sub-current to another step-down unit associated with said third circuit and another of said plurality of circuits next to said third circuit; and d) a bias circuit producing at least a first reference voltage level supplied to the base nodes of said first and second step-down transistors.

2. An electric power supply system as set forth in claim 1, in which said first step-down unit further comprises c-3) a resistive element coupled between said first power supply line and said second step-down transistor.

3. An electric power supply system as set forth in claim 2, in which said resistive element allows current to pass therethrough, the amount of said current passing through said resistive element being larger than a difference between the current flowing out from said first circuit and a maximum current consumed by one of said plurality of electric circuits.

4. An electric power supply system as set forth in claim 1, in which said first step-down units further comprises c-4) a constant current source coupled between said first power supply line and said second step-down transistor.

5. An electric power supply system as set forth in claim 4, in which said constant current source allows current to pass therethrough, the amount of said current passing through said constant current source being larger than difference between the current flowing out from said first circuit and the maximum current consumed by one of said plurality of electric circuits.

6. An electric power supply system as set forth in claim 1, in which said plurality of circuits include third and fourth circuits selected from said second to nth circuits, and in which said plurality of step-down units include a third step-down unit associated with said third and fourth circuits, said third step-down unit comprising c-5) a third step-down transistor having an emitter-and-collector current path between a second power node of said third circuit and a first power node of said fourth circuit, and c-6) a sixth step-down transistor different in conductivity type of a base node from said fifth step-down transistor and having an emitter-and-collector current path between said second power supply line and the first power node of said fourth circuit, a second reference voltage level different from said first reference voltage level being supplied from said bias circuit to the base nodes of said fifth and sixth step-down transistors, said third step-down transistor supplying current approximately equal to difference between current consumed by said third circuit and current consumed by said fourth circuit.

* * * * *